US008568584B2

(12) United States Patent
Almeida et al.

(10) Patent No.: US 8,568,584 B2
(45) Date of Patent: Oct. 29, 2013

(54) METHOD FOR CONTROL OF INSTABILITY IN A DE-ETHANIZER TOWER IN FLUID CATALYTIC CRACKING UNITS AND DELAYED COKING UNITS

(75) Inventors: Mario de Sousa Almeida, Rio de Janeiro (BR); Neyde Alexandra Fraga Marques, Rio de Janeiro (BR); Francisco Carlos da Costa Barros, Nova Iguacu (BR); Claudine Toledo Alvares da Silva Costa, Niteroi (BR)

(73) Assignee: Petroleo Brasileiro S.A.-Petrobras, Rio de Janeiro (BR)

( * ) Notice: Subject to any disclaimer, the term of this patent is extended or adjusted under 35 U.S.C. 154(b) by 872 days.

(21) Appl. No.: 12/635,210

(22) Filed: Dec. 10, 2009

(65) Prior Publication Data

US 2010/0288674 A1 Nov. 18, 2010

(30) Foreign Application Priority Data

Dec. 12, 2008 (BR) ..... 0805249

(51) Int. Cl.

| | |
|---|---|
| ***C10G 7/02*** | (2006.01) |
| ***C10G 7/04*** | (2006.01) |
| ***C10G 7/08*** | (2006.01) |
| ***B01D 3/36*** | (2006.01) |

(52) U.S. Cl.

USPC ..... 208/103; 208/105; 208/113; 208/131; 208/348; 203/6; 203/68; 203/70

(58) Field of Classification Search

USPC ..... 208/103, 105, 113, 131, 348, 364; 203/6, 68, 70

See application file for complete search history.

(56) References Cited

U.S. PATENT DOCUMENTS 5,015,364 A * 5/1991 Harandi ..... 208/236
5,784,538 A * 7/1998 Dzyacky ..... 706/45

OTHER PUBLICATIONS

Kister, Henry Z. (2006). Distillation Troubleshooting: Chapter 2. John Wiley & Sons.*

Dave Langdon et al., "FCC Gas Plant Stripper Capacity", PTQ Revamps and Operations, 2004, pp. 3-7.

Stephen J. Deley et al., "Random Packing Debottlenecks Refinery De-Ethanizing Stripper", Oil and Gas Journal, Aug. 1, 1994, pp. 39-41.

Tony Barletta et al., "Maximizing Gas Plant Capacity", Ptq Revamps and Turnarounds, Spring 2004, pp. 105-113 N.

Henry Z. Kister, "Component Trapping in Distillation Towers: Causes, Symptoms and Cures", CEP, Aug. 2004, pp. 22-33.

* cited by examiner

*Primary Examiner* — Walter D Griffin
*Assistant Examiner* — Renee E Robinson
(74) *Attorney, Agent, or Firm* — Sughrue Mion, PLLC

(57) ABSTRACT

A method is described for controlling instability of operation in a de-ethanizer tower (13) in the gas recovery unit in fluid catalytic cracking units and delayed coking units. The method comprises the step of intervening in the de-ethanizer tower (13) when instability occurs in it, and adjusting the material balance of water in such a way that the excess of water in the feed load stream (9) is removed only as an azeotrope. The intervention is performed by introducing into the feed load stream (9) of the de-ethanizer tower (13) a volume fraction (18) of a flow of hydrocarbon, which may be either dry hydrocarbons or hydrocarbons with a low level of water content.

14 Claims, 1 Drawing Sheet

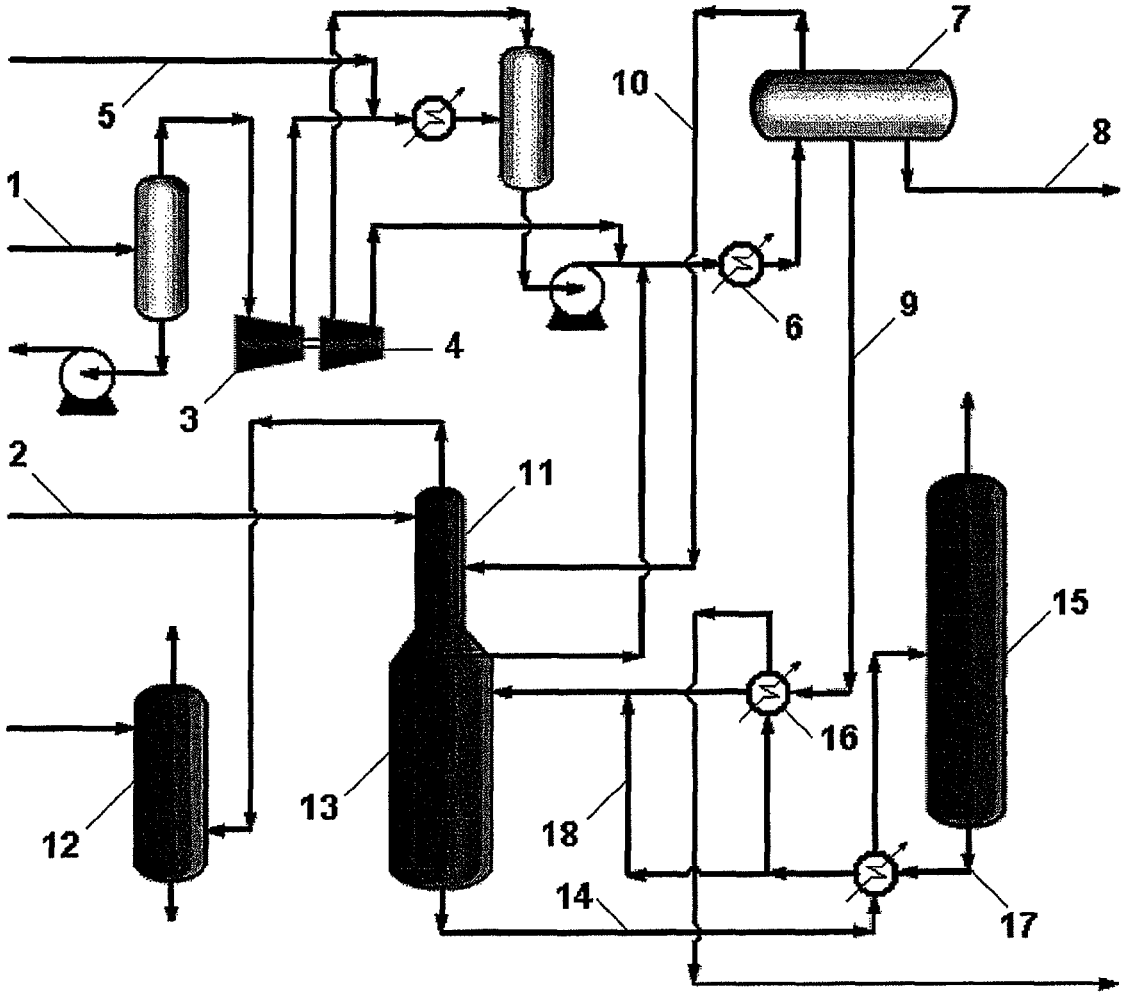
1
2
3
4
5
6
7
8
9
10
11
12
13
14
15
16
17
18

METHOD FOR CONTROL OF INSTABILITY IN A DE-ETHANIZER TOWER IN FLUID CATALYTIC CRACKING UNITS AND DELAYED COKING UNITS

BACKGROUND OF THE INVENTION

1. Field of Invention

The present invention is in the field of methods for controlling instability of operation in a de-ethanizer tower in the gas recovery unit in fluid catalytic cracking units and delayed coking units.

2. Fundamentals of the Invention

Gases coming from the top section of fractionating towers of fluid catalytic cracking units and delayed coking units go through a procedure of compression, normally in two stages, and also a procedure of washing with water for removal of compounds considered to be contaminating.

The gases, now washed, are conducted, at high pressure, to an item of equipment known as a high pressure drum, for separation of water and hydrocarbons.

In terms of the operation in practice, the separation between water and hydrocarbons is subject to failures.

The immediate consequence is a presence and/or dragging of water, in a much higher quantity than foreseen by a unit's plan, together with the flow of hydrocarbons as load to a rectification tower, known as a de-ethanizer tower, in the gas recovery unit. The excess water in this de-ethanizer tower results in instability not only in its own capacity to operate, but also in the equipment connected to it.

The instability generates accumulation of water in the top of the tower, which can even reach a flooding situation. This inundation by excess liquid in the de-ethanizer tower is known by the expression "backup flood." In serious cases, the flooding affects other equipment such as the primary absorption tower, finally causing instability of the entire gas recovery unit.

The flooding takes place, in practice, due to excess formation of steam, known by the expression "choke flood." This excessive formation of steam takes place in the de-ethanizer tower, in the region of the upper half of the column. The excess vapor formed is the cause of the instability in the tower, in the form of its flooding.

It is this situation that leads to the need for reduction of the load of the de-ethanizer tower.

3. Description of the Related Art

In relation to the instability of de-ethanizer towers due to flooding, in the most serious case, the literature always seems puzzled by the fact that the flooding takes place in the higher part of the tower rather than the lower part, the location where there is always the largest load of liquid and, thus, the logical region for the start of a "backup flood."

The available literature on this subject discusses cases that have happened in refineries, refers to problems relating to errors in planning, or indeed raises the question of the disparity between the projection made in computational simulators and the functioning of the equipment in practice.

Given the varying findings about diverse aspects, normally alternatives for recovering the stability of the unit are favored, in the case of problems in the gas recovery unit focusing on the de-ethanizer tower for gas recovery.

Some solutions presented in specialized technical publications can be highlighted, such as the following examples:

Reduction of the de-ethanizer tower load or parameter control (Henry Z. Kister, *Component Trapping in Distillation Towers: Causes, Symptoms and Cures*, CEP, August 2004, at 22-33);

Elimination of the water present in the tower by a removal procedure (Dave Langdon et al., *FCC Gas Plant Stripper Capacity*, PTQ Revamps and Operations, 2004, at 3-7); and Preheating of the load of the de-ethanizer tower to a temperature at which instability does not cause effects (Stephen J. Deley & Kenneth Graf, *Random Packing Debottlenecks Refinery De-Ethanizing Stripper's*, Oil and Gas Journal, Aug. 1, 1994, at 39-41; and Tony Barletta & Scott Fulton, *Maximizing Gas Plant Capacity*, PTQ Revamps and Turnarounds, Spring 2004, at 105-113).

The solution above relating to the reduction of the tower load directly results in reduction of the load processed, both in the fluid catalytic cracking unit and also in the delayed coking unit.

To return the de-ethanizer tower to a stability situation, the solution relating to the removal of water present inside this de-ethanizer tower has the following proposals: installation of a device that allows outflow of the water to a vessel that is external to the tower, for accumulation and subsequent discarding; or the installation of an internal device which normally would be a plate known as a "sump" where the water is accumulated and removed from the system.

The second procedure involves the vaporization of the accumulated water before entering the de-ethanizer tower, by prior heating of the tower load to a temperature at which the water will be vaporized, that is to say, it does not enter the tower in liquid form.

The proposals for solution via removal of water and vaporization of the accumulated water have limitations. For example, for the removal of the water, the water still descends inside the tower, to be withdrawn from it only afterward.

In the prior vaporization of the water, although it avoids the water descending through the tower, if there is excessive vaporization of water, also, due to the effect of the temperature, light components in the load—such as hydrocarbons with one to four atoms of carbon—are excessively vaporized, which generates high recyclings of these light hydrocarbons to the high pressure drum with an overload of the systems involved, also affecting the primary and secondary absorbers and leading to considerable losses of hydrocarbons with three atoms of carbon in the combustible gas.

The literature, however, does not mention the occurrence of a phenomenon that takes place between the water and the hydrocarbons, which is the formation of azeotropes that are present in the load of the de-ethanizer tower. This formation is caused by water solubility in the hydrocarbon stream and also by accumulation in the high pressure drum.

The inventors realized that the azeotropy between the water and the hydrocarbons is the main factor responsible for formation of excess steam and, consequently, the basic cause of the generation of instabilities and flooding in the de-ethanizer tower, problems which until today's date have not had efficient solutions in the state of the art.

SUMMARY OF THE INVENTION

Exemplary embodiments of the present invention address the above disadvantages and other disadvantages not described above. Also, the present invention is not required to overcome the disadvantages described above.

An object of the present invention is to provide a method of effectuating control of instability of operation in a de-ethanizer tower in the gas recovery unit in fluid catalytic cracking units and delayed coking units.

The objective of the present invention is achieved by a method that comprises intervening in the de-ethanizer tower when instability occurs in it, followed by adjusting the material balance of water in the de-ethanizer tower in such a way that the excess of water of the feed load stream is withdrawn only as an azeotrope. The intervention is carried out through the introduction in the feed load stream of the de-ethanizer tower of a volume fraction of a stream of hydrocarbon, where the stream of hydrocarbon may be dry hydrocarbon or hydrocarbon with low water content. The volume fraction may be internal to the gas recovery unit or external to the gas recovery unit.

Basically, the method can be employed for stabilizing a de-ethanizer tower in any operational situation, with special attention to situations where there is no pre-heating of the feed load. It can also be used in gas recovery units that are already built and/or in operation with a simple implementation.

The present invention provides control of the frequent instabilities in de-ethanizer towers; caries out an action that corrects the difficulties generated by inappropriate operation of the high pressure drum; allows maintenance of the quantity of load of fluid catalytic cracking units and delayed coking units even in situations of excess free water; and has a low implementation cost, among other benefits.

BRIEF DESCRIPTION OF THE DRAWING

In order to describe the manner in which the above-recited and other advantages and features of the present invention can be obtained, a more particular description of the present invention briefly described above will be rendered by reference to specific embodiments thereof which are illustrated in the appended drawing. Understanding that the drawing depicts only typical embodiments of the present invention and is not therefore to be considered to be limiting of its scope, the present invention will be described and explained with additional specificity and detail through the use of the accompanying drawing.

The drawing or "FIGURE" is a representation of a typical installation of a gas recovery unit according to one embodiment of the present invention.

It should be noted that the drawing is not drawn to scale. It also should be noted that the drawing is only intended to facilitate the description of embodiments of the present invention.

DETAILED DESCRIPTION OF THE INVENTION

It is to be understood that both the foregoing general description and the following detailed description are exemplary and are intended to provide further explanation of the invention claimed.

The present invention is directed to a method of controlling instability of operation of a de-ethanizer tower present in the gas recovery unit of fluid catalytic cracking units and delayed coking units.

The main function of the gas recovery unit in fluid catalytic cracking units and delayed coking units is treatment of the fluid coming from a fractionating tower separating into a stream of top gas (1), which is in gaseous form, and a liquid stream of light unstabilized naphtha (2). These streams are processed, resulting in products that are saleable, such as, for example, fuel gas (FG), liquefied petroleum gas (LPG), and light naphtha.

The separation of products is carried out through processes of compression, washing with water, cooling of the gas flows, absorption and separation.

The drawing is used for optimum visualization of the various components that will be mentioned herein below, and which interrelate with or are part of the object of the present invention.

The top gas stream (1), after undergoing compression, generally in two stages that involve a first compressor (3) and a second compressor (4), receives a stream of water (5) for washing of the gases and is cooled by a first heat exchanger (6).

The top gas stream (1), now cooled, is partially condensed and conducted to a high pressure drum (7) where it is separated into: a liquid aqueous phase referred to as the acid water stream (8), a liquid hydrocarbon phase which is referred to as the feed load stream (9), and a gaseous phase which is referred to as the gas stream (10).

The gaseous phase outflow from this high pressure drum (7) is conducted by the gas stream (10) to a primary absorbing tower (11) for the fractions of hydrocarbons of three and four atoms of carbon to be separated, which hereinafter will be referred to by the symbols "$C_3$" and "$C_4$".

These fractions are separated from the gaseous phase by a process of absorption of heavier hydrocarbons.

The gas flowing from the primary absorbing tower (11) is conducted to a second tower called a secondary absorbing tower (12), so that the heavier components and possibly $C_3$ and $C_4$ that were not absorbed, due to limitations of the operational conditions or of the absorption liquid, can be absorbed.

The liquid streams (8) and (9) of the high pressure drum (7) result from a process of decantation. The acid water stream (8), i.e., aqueous phase, is conducted for treatment to a specific unit, while the feed load stream (9), i.e., a liquid hydrocarbon phase, is conducted for rectification in a de-ethanizer tower (13).

The product at the base of the de-ethanizer tower (13) is then conducted by a primary base bottoms stream (14) to fractionating into LPG and naphtha in a light de-butanizer tower (15).

In normal operation of gas recovery units of fluid catalytic cracking units and delayed coking units, in certain situations, the liquid hydrocarbon phase drags part of the aqueous phase. This liquid hydrocarbon phase is the feed load of the de-ethanizer tower (13).

The presence of dragged water in the liquid hydrocarbon phase causes instability in the operation of the de-ethanizer tower (13), which can cause a situation of flooding that will harm the processing of all the systems linked to it. High flows of water in the feed of the de-ethanizer tower (13) can be generated by inappropriate operation of the high pressure drum (7).

Although already discussed above, it is worth remembering here the two solutions presented in the description of the related art.

A first solution is removal of the water present in the interior of the de-ethanizer tower (13). This solution does not prevent the water from descending in the tower to the point at which it is in practice removed, that is to say, it does not attack the basic cause.

The other solution, the installation of a pre-heater (16) to cause vaporization of the water present in the flow of the feed load (9) before its introduction into the de-ethanizer tower (13), depends principally on the volume of water present. In situations of high presence of water in the feed load stream (9) due to bad functioning or bad operation of the high pressure drum (7), this solution presents serious limitations since it also causes excessive vaporization of light components such as hydrocarbons in the range $C_1$ to $C_4$. The principal consequence of this excessive vaporization is generation of high recycling of light hydrocarbons to the high pressure drum (7) and overload of the systems involved, which can lead to a high loss of $C_3$ hydrocarbons in the combustible gas.

Table 1 below provides information on what happens in a de-ethanizer tower (13) at a pressure of 16 kgf/cm$^2$ abs. In the table are the boiling points of pure hydrocarbons (HC) and their azeotropes (AZ) with water at this pressure. The azeotropes that form between water and the hydrocarbons are minimum azeotropes, that is to say, they behave as pure components with a boiling point lower than the boiling point of both water and the hydrocarbon.

TABLE 1

| Hydrocarbon | Boiling point of the HC (° C.) | Boiling point of the AZ (° C.) | Difference in boiling point, (° C.) | Pure HC equivalent to the AZ, without considering the azeotropy |
|---|---|---|---|---|
| Propene | 37.8 | 37.6 | 0.2 | |
| Propane | 46.0 | 45.7 | 0.3 | |
| Isobutene | 87.7 | 85.7 | 2.0 | |
| nButane | 101.3 | 98.1 | 3.2 | |
| nPentane | 149.1 | 136.4 | 12.8 | |
| 2,3 dimethyl butene-1 | 176.5 | 153.0 | 23.5 | |
| Hexene-1 | 184.7 | 157.9 | 26.8 | |
| nHexane | 191.7 | 161.4 | 30.3 | |
| nHeptane | 228.5 | 176.5 | 52.0 | 2,3 dimethyl butene-1 |
| nOctane | 263.0 | 186.0 | 77.0 | Hexene-1 |
| Nonene-1 | 290.2 | 190.9 | 99.3 | nHexane |

Analyzing Table 1, one can see the trend to a maximum value in the boiling points of the azeotropes, which is the boiling point of water at the pressure of operation of the de-ethanizer tower (13), that is to say, at a pressure of 16 kgf/cm$^2$ abs, the boiling point is about 200.4° C. This fact causes the boiling points of the azeotropes of heavier hydrocarbons to tend, asymptotically, to have the temperature of 200.4° C.

In the case of heavier hydrocarbons, there is an accentuated reduction in the boiling point of the azeotrope in relation to the pure hydrocarbon and, with this reduction, the azeotrope formed by the heavy hydrocarbon with water behaves as if it were a lighter, pure hydrocarbon.

For stabilized naphtha, for example, it is known that light components are present in a minimum quantity or even absent. Thus, if small flows of stabilized naphtha are added to the load of the de-ethanizer tower (13), the heavier components of the stabilized naphtha incorporate high'capacity for carrying water in the form of azeotropes.

The heavier the hydrocarbons are, the higher the levels of water with which the heavier components form azeotropes.

Returning to the numbers given in Table 1, it can be seen that Nonene-1, when in an azeotropic state with water, has a boiling point (190.9° C.) approximately equal to the boiling point of pure nHexane (191.7° C.).

Thus, in the liquid-vapor equilibrium between hydrocarbons and water, the vapor phase behaves as if it were a lighter phase than it would behave in the absence of water due to the effect of the azeotropy.

As mentioned above, but it is worth emphasizing, another aspect of the behavior of the azeotropes of hydrocarbon and water is the tendency for the water content level of the azeotrope to be greater, the heavier the hydrocarbon is.

This fact can be observed in Table 2 below, which shows levels of water in azeotropes.

TABLE 2

| Hydrocarbon | % by weight of water in the azeotrope |
|---|---|
| Propene | 0.17 |
| Propane | 0.25 |
| Isobutene | 0.52 |
| nButane | 2.0 |
| nPentane | 6.2 |
| Hexene-1 | 11.3 |
| nHexane | 12.6 |
| nHeptane | 20.6 |
| nOctane | 30.1 |
| Nonene-1 | 38.9 |

In view of everything stated above, the present invention presents a solution for the instability of a de-ethanizer tower (13) in any operational situation, including the cases where there is an absence of a pre-heater (16) in the feed load stream (9); it can be applied in units already built and/or in operation; it does not lead to reduction of volume of the feed load stream (9); and it does not overload the interlinked systems, through a simple operation, as described below.

The present invention provides a method for control of instability in a de-ethanizer tower in fluid catalytic cracking units and in delayed coking units, caused by carriage of water together with the liquid phase of hydrocarbons coming out of a high-pressure drum. The method comprises intervention in the instability of the de-ethanizer tower (13) and has as its basis the adaptation of the material balance of water, so that the excess water introduced in the feed load stream (9) is removed only as an azeotrope, whether the excess water is due to the water being dissolved in the hydrocarbon or dragged in the form of droplets coming from the high pressure drum (7).

The objective of the present invention is achieved through the introduction in the feed load stream (9) of the de-ethanizer tower (13) of a stream of dry hydrocarbons or hydrocarbons with low water content. For example, a dry hydrocarbon is considered to be a stream with total absence of water. A low water content is considered to be a stream with a maximum 10 ppm of water.

The stream of dry hydrocarbons or hydrocarbons with low water content is, preferably, a stream of stabilized light naphtha, for the reasons set forth above.

This flow of stabilized light naphtha typically has a true boiling point greater than or equal to −5° C. and less than or equal to 200° C.

The origin of the flow of stabilized light naphtha may be internal or external to the fluid catalytic cracking unit or delayed coking unit.

The origin that is internal to the unit comes from a volume fraction (18) of the second base stream (17) of a de-butanizer tower (15).

The second base stream (17) of stabilized light naphtha can have a high temperature around 280° C.

The second base stream (17) of stabilized light naphtha can also have a temperature as low as around 25° C.

The control of the introduction of the volume fraction (18) of the second base stream (17) or of the stream external to the stabilized light naphtha unit is defined based on the development of the phenomenon of azeotropy.

When instability occurs, the moment of intervention can be chosen on one more of the following bases (A) to (D): (A) as a function of the water level contained in the feed load stream (9) of the de-ethanizer tower (13); (B) as a function of the value of the pressure differential between the top and the base of the de-ethanizer tower (13); (C) as a function of the temperature of the fluid in a plate situated in the region of the upper half of the de-ethanizer tower (13); or (D) in specific situations, it can also be defined as a function of the temperature at the top of the de-ethanizer tower (13).

The second base stream (17) of the de-butanizer tower (15) has a very similar composition to the feed load stream (9) from the de-ethanizer tower (13), with an absence of $C_2$ and $C_3$ hydrocarbons, and low levels of $C_4$ hydrocarbons, and also has an absence of, or a low content of, water.

The volume fraction (18) of the second base stream (17) of the de-butanizer tower (15) forms an azeotrope between the excess water in the feed load stream (9) of the de-ethanizer tower (13) and the hydrocarbons present in the stabilized light naphtha. Since the boiling point tends to be reduced, the azeotrope will be removed before accumulation of vapor at the top of the de-ethanizer tower (13), and thus also before its consequent flooding occurs, whether at the top or at the base of the de-ethanizer tower.

The absence of light components lower than $C_4$ in the second base stream (17) of the de-butanizer tower (15) avoids overload of the systems of gases connected to the first compressor (3) and to the second compressor (4) of the gas recovery unit.

The control of instabilities by means of the present invention: provides an action correcting the difficulties generated by inappropriate operation of the high pressure drum (7); provides maintenance of the load of the fluid catalytic cracking units and delayed coking units, even in situations of excess free water in the hydrocarbon stream coming from the high pressure drum (7); provides operational simplicity compared to the state of the art solutions; does not generate loss for the systems upstream and downstream of the compressors (3) and (4) of the gas recovery unit; provides ease of control, since the operation of the flow of stabilized light naphtha is activated by the indicators of state of the de-ethanizer tower itself (13); and provides low cost of implantation in units in operation.

EXAMPLES

Experiments in a simulator of typical situations for the type of equipment that is the target of the present invention were carried out, and the results obtained are shown in Table 3 below. The equipment is a de-ethanizer tower (13).

TABLE 3

| ITEM | Units | Situation A | Situation B |
|---|---|---|---|
| Load heating system | — | With pre-heater | With pre-heater plus naphtha |
| Load of liquid hydrocarbon coming from the high pressure drum as feed load flow in the Tower. | Kg/h | 192,000 | 230,400 |
| Temperature of the feed load flow of the Tower. | ° C. | 75 | 75 |
| Water contained in the liquid hydrocarbon prior to the pre-heater. | Kg/h | 1,536 | 1,536 |
| Flow of stabilized light naphtha | Kg/h | — | 38,400 |
| Operational condition of the tower | — | Flooded | Stable |

"Situation A" shows data of the de-ethanizer tower (13) in a flood situation. "Situation B" shows data after the application of the method of the present invention, demonstrating the return of the de-ethanizer tower (13) to a situation of stability. For the simulation, the following considerations were made:

Situation A: A load of liquid hydrocarbon coming from the high pressure drum (7) in the form of a feed load stream (9) which, before entering the de-ethanizer tower (13), is pre-heated in the pre-heater (16);

Situation B: A load of liquid hydrocarbon coming from the high pressure drum (7) in the form of a feed load stream (9) which, before entering the de-ethanizer tower (13), is pre-heated in the pre-heater (16) and has added to it after the pre-heater (16) part of the second base stream (17) of the de-butanizer tower (15) composed of stabilized light naphtha, as a temperature of about 218.5° C. and without water.

Although the present invention has been described in its preferred form of operation, the principal concept that guides the present invention, a method for controlling instability of operation in a de-ethanizer tower (13) in the gas recovery unit in fluid catalytic cracking units and also in delayed coking units, remains preserved as to its innovative character, where those who are usually versed in the technique can create and practice variations, modifications, alterations, adaptations and equivalent, appropriate to and compatible with the means of work in question, without, however, being distanced from coverage by the spirit and scope of the present invention, which are represented by the claims set out below.

The present invention is susceptible to various modifications and alternative means, and specific examples thereof have been shown by way of example in the drawing and are herein described in detail. It should be understood, however, that the present invention is not to be limited to the particular devices or methods disclosed, but to the contrary, the present invention is to cover all modifications, equivalents, and alternatives falling within the spirit and scope of the claims.

What is claimed is:

1. A method for control of instability in a de-ethanizer tower in a gas recovery unit of fluid catalytic cracking units and delayed coking units caused by carriage of water together with a liquid phase of hydrocarbons in a feed load stream (9) coming from a high pressure drum, comprising:

intervening in the operation of the de-ethanizer tower (13) when instability occurs in the de-ethanizer tower; and adjusting the material balance of water in the de-ethanizer tower to withdraw excess water of the feed load stream only as an azeotrope, wherein the intervention includes introduction into the feed load stream of a stream of hydrocarbons, wherein the stream of hydrocarbons comprises dry hydrocarbons or hydrocarbons with a low water content, and wherein the introduction is internal or external to the fluid catalytic cracking unit or delayed coking unit.

2. The method in accordance with claim 1, wherein the moment of intervention is chosen as a function of one or more of the following (A) to (D): (A) a level of water contained in the feed load stream (9) of the de-ethanizer tower (13); (B) the differential of pressure between the top and the base of the de-ethanizer tower (13); (C) the temperature of fluid in a plate situated in the region of the upper half of the de-ethanizer tower (13); or (D) the temperature of the top of the de-ethanizer tower (13).

3. The method in accordance with claim 1, wherein a volume fraction (18) of the hydrocarbon flow internal to the gas recovery unit comprises stabilized light naphtha.

4. The method in accordance with claim 3, wherein the flow of stabilized light naphtha has a true boiling point greater than or equal to −5° C. and less than or equal to 200° C.

5. The method in accordance with claim 3, wherein the flow of hydrocarbon comprising stabilized light naphtha internal to the gas recovery unit comes from a second base stream (17) of a de-butanizer tower (15).

6. The method in accordance with claim 5, wherein the second base stream (17) has a temperature from about 25° C. to about 280° C.

7. The method in accordance with claim 5, wherein the quantity of the volume fraction (18) of the second base stream (17) of stabilized light naphtha is based on the development of an azeotrope.

8. The method in accordance with claim 1, wherein a volume fraction (18) of the hydrocarbon flow external to the gas recovery unit comprises stabilized night naphtha.

9. The method in accordance with claim 8, wherein the flow of stabilized light naphtha has a true boiling point greater than or equal to −5° C. and less than or equal to 200° C.

10. A method for stabilizing a de-ethanizer tower in a gas recovery unit of a fluid catalytic cracking unit or a delayed coking unit, comprising:

introducing a fraction of hydrocarbons into a feed load stream of the de-ethanizer tower to adjust the material balance of water in the de-ethanizer tower and to withdraw excess water of the feed load stream only as an azeotrope.

11. The method in accordance with claim 10, wherein the fraction of hydrocarbons comprises dry hydrocarbons or hydrocarbons with a low water content.

12. The method in accordance with claim 10, wherein the fraction of hydrocarbons comes from a de-butanizer unit that is operating within the gas recovery unit.

13. The method in accordance with claim 10, wherein the feed load stream comes from a decantation unit.

14. The method in accordance with claim 10, wherein introduction of the fraction of hydrocarbons into the feed load stream is based on an evaluation of one or more of the following conditions (A) to (D):

(A) a level of water contained in the feed load stream;

(B) the differential of pressure between the top and the base of the de-ethanizer tower (13);

(C) the temperature of fluid in a plate situated in the region of the upper half of the de-ethanizer tower (13); or (D) the temperature of the top of the de-ethanizer tower (13).

* * * * *